US005104311A

United States Patent [19]

Maughan et al.

[11] Patent Number: 5,104,311

[45] Date of Patent: Apr. 14, 1992

[54] AUTOREGULATION OF PRIMARY AERATION FOR ATMOSPHERIC BURNERS

[75] Inventors: James R. Maughan, Scotia, N.Y.; James R. Cahoe; Reza Ghassemzadeh, both of Louisville, Ky.

[73] Assignee: General Electric Comany, Schenectady, N.Y.

[21] Appl. No.: 638,583

[22] Filed: Jan. 8, 1991

[51] Int. Cl.[5] ..... F23H 5/00

[52] U.S. Cl. ..... 431/75; 431/354; 239/75

[58] Field of Search ..... 431/75, 354; 239/75

[56] References Cited

U.S. PATENT DOCUMENTS

| | | | |
|---|---|---|---|
| 1,972,836 | 6/1934 | Te Pas | 431/75 |
| 3,825,404 | 7/1974 | DeGouville | 431/354 |
| 4,565,521 | 1/1986 | Hancock | 431/75 |
| 4,572,154 | 2/1986 | Schweitzer | 126/39 E |
| 4,728,282 | 3/1988 | May | 431/75 |

*Primary Examiner*—Carroll B. Dority

*Attorney, Agent, or Firm*—James R. McDaniel; James C. Davis, Jr.; Paul R. Webb, II

[57] ABSTRACT

In a gas burner assembly, the gas burners are equipped with a device constructed of a thermostatic, bimetallic material which autoregulates the amount of primary air that can be entrained into the burner such that the likelihood of an occurrence of lifting or flashback is substantially reduced, and elevated CO emissions at reduced firing rates are eliminated.

13 Claims, 4 Drawing Sheets

AUTOREGULATION OF PRIMARY AERATION FOR ATMOSPHERIC BURNERS

BACKGROUND OF THE INVENTION

This invention relates generally to atmospheric gas burners and in particular to improvements in such burners to reduce the likelihood of lifting, yellow-tipping, flashback and excessive carbon monoxide (CO) emissions.

It is known, in prior gas burner systems having only a conventional mixing tube, that lifting of flames in a gas burner can cause reduced performance and, if extreme, increased CO emissions. This well-known lifting effect results when too much primary air is being entrained into the burner and usually occurs during the initial operation of the burner when the burner is cold. Equally important, lifting flames are noisy and create the perception of a serious burner problem, which may result in lost sales and expensive, unnecessary service calls. Furthermore, burners which experience only marginal lifting in one area, may experience severe lifting in another part of the country because of natural gas variations. As a result, lifting is a serious concern in gas range burner design.

The lifting problem has defied a solution for many years, because any design change which reduces lifting, encourages flashback. Essentially, lifting occurs when the flame speed is significantly lower than the port velocity of the air/gas mixture and the flowing mixture blows the flame away. Flashback is the opposite instability; the flame speed is significantly higher than the port velocity, and the flame burns back into the burner.

The problem encountered in conventional gas burner designs is compounded because flame speed and port velocity of the gas change significantly as the burner temperature increases after ignition, even if the firing rate of the burner is held constant. In FIG. 3, which represents data derived using a conventional atmospheric gas burner of the type commonly used as surface burners in domestic gas ranges, $T_{port}$ equals the temperature of the air/gas mixture at the port; $U_p$ equals the velocity of the air/gas mixture through the port; and PA equals the primary aeration as a percent of stoichiometric. Immediately after ignition, the burner associated with the data in FIG. 3 lifted. As the burner heats up, the port velocity increases because the drop in fluid density with heating more than offsets the decrease in entrained primary air. However, the flame speed also increases with port temperature and increases more rapidly than the port velocity. Consequently, the flame stopped lifting, typically, about 45 seconds after ignition.

Two apparent solutions to the lifting problem are: (1) increase the port area, thereby reducing the port velocity; or (2) uniformly reduce the amount of entrained air by increasing the burner loss coefficient. Neither of these is acceptable because the first approach will result in flashback when the firing rate of the hot burner is reduced and the second will cause yellow-tipping (ends of the flame turn from blue to yellow which indicates that the flame is not getting enough air) and high CO emissions in the hot burner, especially for lower firing rates.

Consequently, a more advantageous gas burner system would be presented if excess primary air were avoided at ignition, undesirable reductions in PA at lower firing rates were inhibited and such amounts of lifting, flashback, yellow-tipping or high CO emission were reduced.

It is apparent from the above, that there exists a need in the art for a gas burner system which is efficient through simplicity of parts and uniqueness of structure, and which at least equals the safety characteristics of known gas burner systems, but which at the same time substantially increases performance. It is a purpose of this invention to fulfill this and other needs in the art in a manner more apparent to the skilled artisan once given the following disclosure.

SUMMARY OF THE INVENTION

Generally speaking, this invention fulfills these needs by using burner temperature to control burner geometry, which consequently affects air entrainment. In particular, the invention provides a gas burner system which is comprised of gas burner having a mixing tube, burner head, and a primary air flow control means operative to autoregulate an amount of primary air which can be entrained into said gas burners as a function of burner temperature such that a likelihood of an occurrence of lifting, flashback, and elevated CO emissions is substantially reduced.

In accordance with a broad aspect of the invention, the airflow autoregulating means comprises a thermostatic, bimetallic member, disposed in the primary air injection passageway of the burner, which is operative to vary the effective cross-sectional area of the passageway proximate the member as a function of burner temperature. In particular, the member operates to reduce the effective cross-sectional area when the burner is cold and increase this area when the burner is hot. The reduced area reduces the primary air entrained by the burner when cold thereby reducing the likelihood of lifting; the increased area increases the amount of entrained primary air when the burner is hot to prevent flashback.

In one preferred form of the invention the bimetallic member comprises a tubular extension of the mixing tube, slitted to form therein longitudinally extending fingers, spaced from the burner head to define an annular gap therebetween. The fingers flex outwardly to increase the cross-sectional area of the gap as the burner temperature increases. By this arrangement the cross-sectional area is smaller, restricting the amount of entrained primary air when the burner is cold and the area is larger, increasing the amount of entrained primary air when the burner is hot.

In accordance with another preferred form of the invention the bimetallic member comprises a generally planar diaphragm supported in the burner head disposed substantially transverse of and spaced from the mixing tube, defining an annular gap therebetween. The flexing of the diaphragm varies the effective cross-sectional area of this gap, to provide a lesser gap when the burner is cold and a greater gap when the burner is hot to permit the desired amount of entrained primary air for both cold and hot burner conditions. In this way, not only are a relatively small number of pieces employed in constructing the primary air flow means, but the unique structure provides an autoregulating device that efficiently controls the amount of primary air which is entrained into the gas burner which, in turn, controls lifting, flashback or CO emissions.

The preferred gas burner system, according to this invention, offers the following advantages: easy assembly and repair; good stability; good durability; good economy; high strength for safety; and excellent primary air entrainment characteristics. In fact, in many of the preferred embodiments, these factors of durability, assembly and repair, and primary air entrainment characteristics are optimized to an extent considerably higher than heretofore achieved in prior, known gas burner systems.

BRIEF DESCRIPTION OF THE INVENTION

FIG. 1*a* is a side plan view of a gas burner system, in its initial, cooled operating condition, according to the present invention;

FIG. 1*b* is a side plan view of the gas burner system, in its heated operating condition, according to the present invention;

DETAILED DESCRIPTION OF THE INVENTION

Figure 1A:
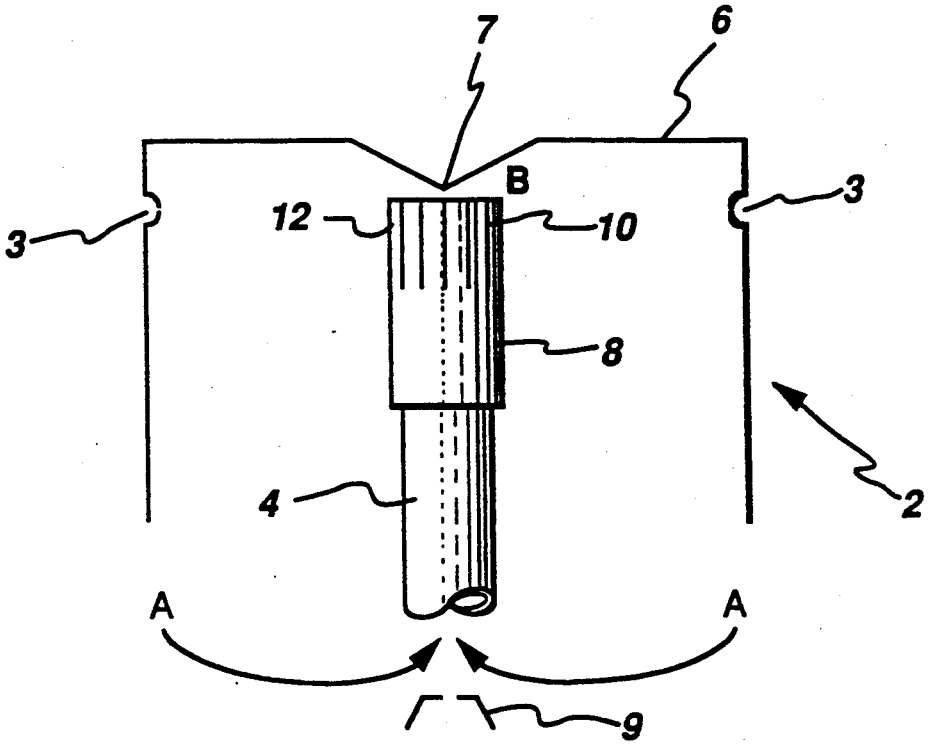

With reference first to FIG. 1*a*, there is schematically illustrated an atmospheric gas burner system 2 in its initial cold state, having a conventional, cylindrical gas mixing tube 4 and a conventional cap 6 having a depressed central region 7 and ports 3. While only a gas range burner system 2 is depicted it is to be understood that the present invention could be employed in other technical areas which utilize gas such as ovens, furnaces and hot water heaters. Located along one end of tube 4 and adjacent cap 6 is cylindrical extension 8.

Gas from conventional orifice 9 mixes with primary air which enters tube 4 at A. This air/gas mixture passes through an air/gas injection passageway formed by tube 4, extension 8 and head 6 enroute from orifice 9 to ports 3. As will be hereinafter described in greater detail, extension 8 cooperates with the depressed region 7 of head 6 to define a variable gap therebetween, designated B.

In accordance with the invention burner 2 is provided with means for autoregulating the amount of primary air which is entrained into the burner.

Figure 1B:
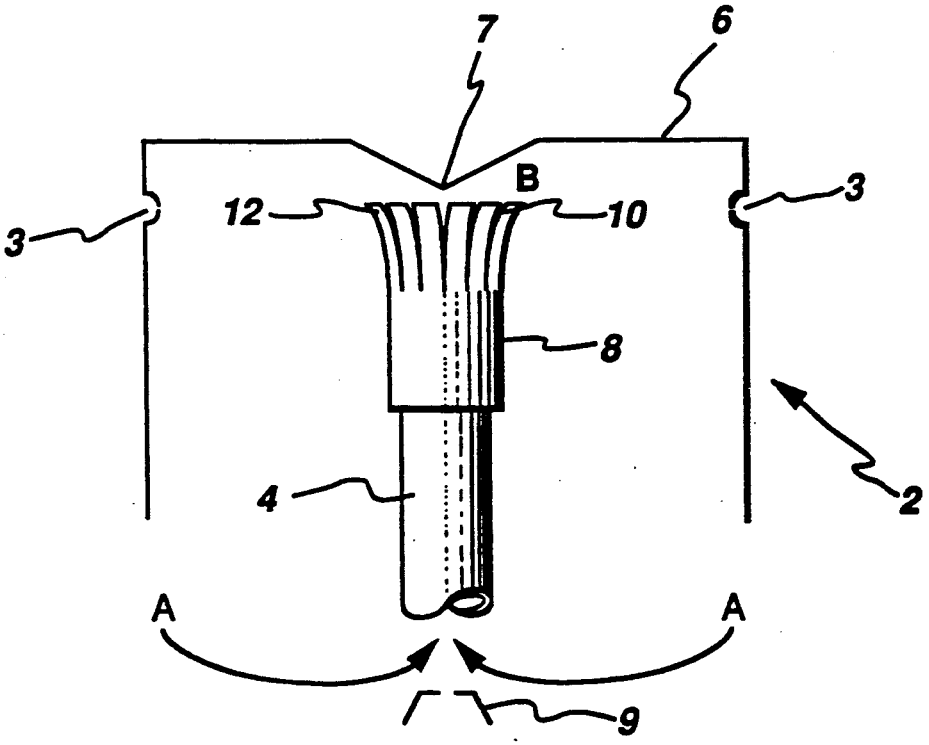

In the embodiment of FIGS. 1*a* and 1*b*, this autoregulating means is provided by extension 8 which comprises a tubular member constructed of any suitable thermostatic bimetallic material. In the illustrative embodiment extension 8 is formed of 22% nickel, 3% chromium and the balance iron on the high side and 36% nickel and the balance iron on the low side, with dimensions on the order of $\frac{3}{4}''$ (diameter)$\times\frac{7}{8}''$ (length)$\times$10 mils (thickness).

Extension 8 includes slits 10 and fingers 12 which are formed on extension 8 by well-known slitting techniques. Slits 10 are located along the longitudinal dimension of extension 8 and are preferably $\frac{5}{8}''$ in length and there is approximately $\frac{1}{8}''$ in the circumferential direction between respective slits 10. The free ends of fingers 12 are spaced from burner head 6 so as to define annular gap B therebetween.

In operation, gas burner system 2, is initially in a cold state, as depicted in FIG. 1*a*. In this cold state, fingers 12 of extension 8 are relatively straight and create a relatively small inlet area, in which primary air can enter extension 8 along arrows A. In this way, the likelihood of an occurrence of lifting is substantially reduced because the amount of primary air entrained into the end of mixing tube 4 is reduced.

FIG. 1*b* depicts gas burner system 2 when system 2 has reached a steady-state, hot operating temperature, typically 450° F. As can be seen, fingers 12 are bent outwardly, typically 70–80 mils, as extension 8 heats up. This bending s caused by the inherent mechanical properties in the thermostatic, bimetallic material of extension 8. This outward bending of fingers 12 increases the effective cross-sectional area of gap b thereby increasing the amount of primary air entrained into the burner.

In this condition, the likelihood of an occurrence of flashback is substantially reduced because more primary air can be entrained into mixing tube 4 as gas burner system 2 heats up. In addition, CO emissions are reduced.

Figure 4:
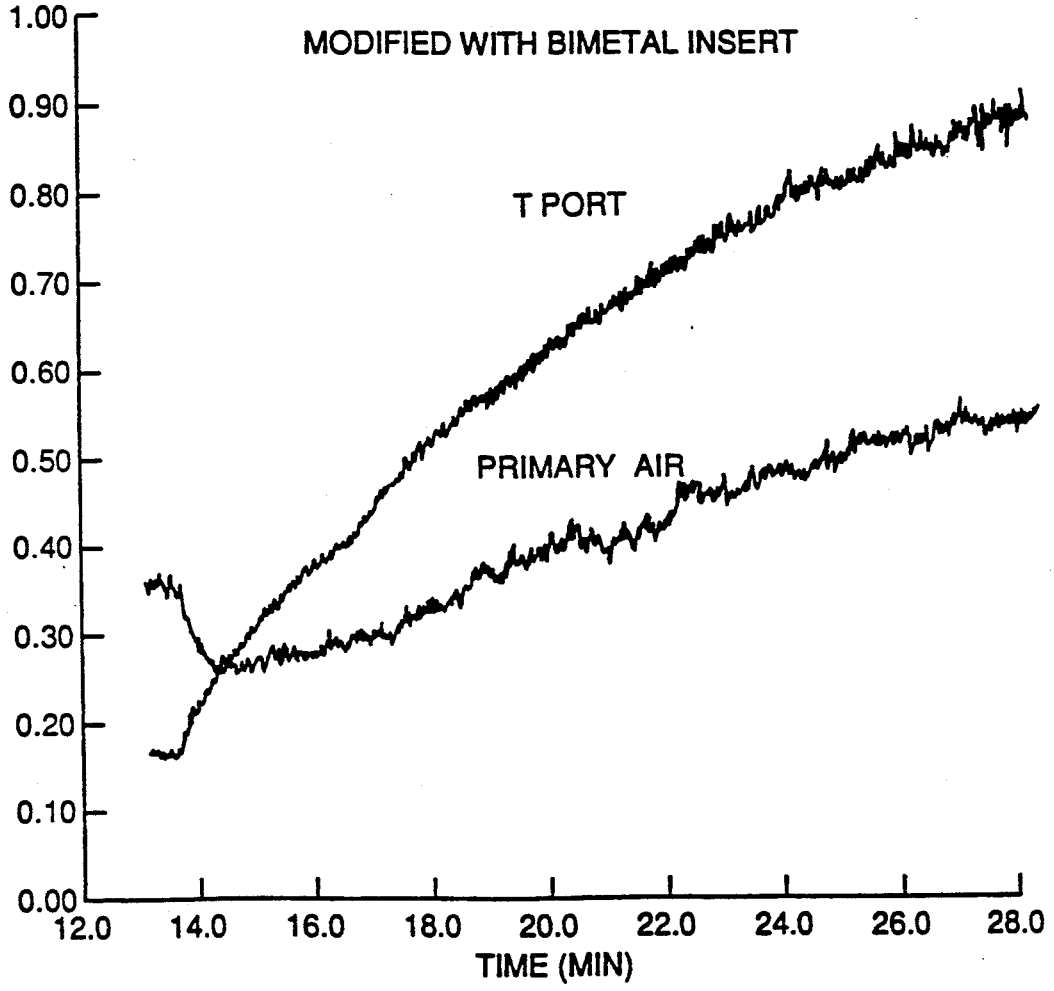
FIG. 4 is a graphical representation of the operating characteristics of the present invention.

FIG. 4 shows the improved results, namely, the substantial reduction of the likelihood of an occurrence of lifting or flashback when the present invention as depicted in FIG. 1, is employed. In particular, it can be seen that, initially, because the $T_{port}$ or temperature of the portal or mixing tube 4 is low, the amount of entrained primary air entering along arrows A is low so that the likelihood of an occurrence of lifting is substantially reduced. However, as the $T_{port}$ increases, the system 2 autoregulates itself such that the amount of entrained primary air along arrows A increases which substantially reduced the likelihood of an occurrence of flashback, improves CO emissions, and reduced the possibility of yellow-tipping.

Figure 2:
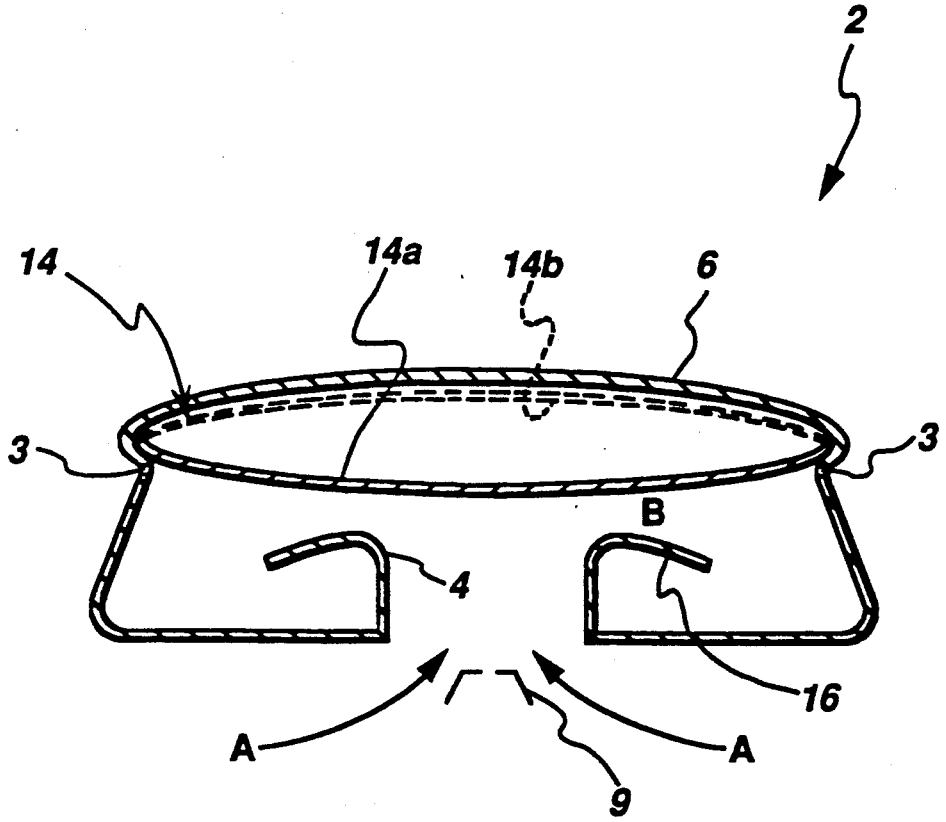
FIG. 2 is a side plan view of another embodiment of the present invention.
Figure 3:
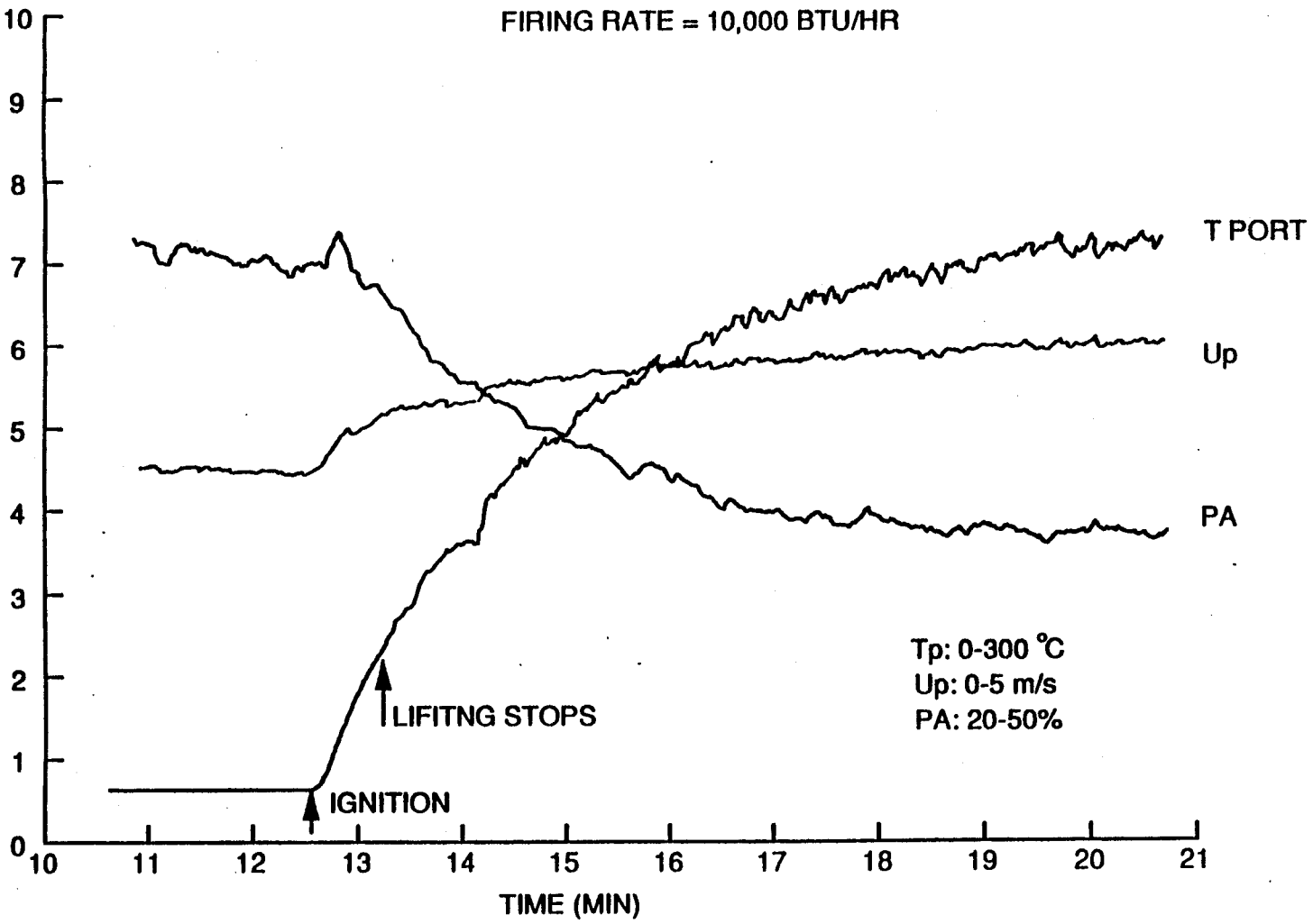
FIG. 3 is a graphical representation of the operating characteristics of the prior art gas burners.

Another embodiment of the gas burner system 2 is shown in FIG. 2. It is to be understood that those elements in FIG. 2 which correspond with similar elements in FIGS. 1*a* and 1*b* will be numbered the same as in FIGS. 1*a* and 1*b*. In particular, system 2 has a conventional gas mixing tube 4, with curved ends 16, a conventional cap 6. In this embodiment the autoregulating means comprises a diaphragm 14.

Diaphragm 14 is suitably supported in burner head 6, disposed substantially transverse to and spaced from the open end of mixing tube 4. An annular gap B is formed between the opposing surfaces of diaphragm 14 and annular collar 16 formed by the flared end of mixing tube 4. The effective cross-sectional area of this gap varies as diaphragm 14 flexes. In its cold state represented by the solid lines 14*a* in FIG. 2, gap B is at its minimum providing a reduced effective cross-sectional area for the gap. Consequently, less primary air is entrained, thereby reducing the likelihood of the occurrence of lifting. As the burner approaches its steady state temperature of approximately 450° F., diaphragm 14 flexes to the position shown in dotted lines 14*b* in FIG. 2. In this state, effective cross-section at gap B is increased resulting in more primary air being entrained. The increase in entrained primary air substantially reduces the likelihood of an occurrence of flashback.

Diaphragm 14 is substantially rectangular but it is to be understood that it can be of a variety of shapes as long as diaphragm 14 presents a smooth surface to mixing tube 4 and provides the desired effective cross-sectional area for gap B. Diaphragm 14 is constructed by conventional diaphragm forming techniques and is preferably of the same material as extension 8, namely, a suitable thermostatic, bimetallic material. Diaphragm 14 preferably has the following dimensions: 0.7–1.0" (width)$\times$1–2" (length)$\times$10 mils (thickness).

Once given the above disclosure, many other features, modifications and improvements will become apparent to the skilled artisan. For example, other means for varying the cross-sectional area of the passageway to essentially throttle the flow of the air gas mixture as a function of burner temperature could be employed, such as a butterfly valve, or rotating vane, or a bimetallic honeycomb which opens when heated. Such features, modifications and improvements are, therefore, considered to be a part of this invention, the scope of which is to be determined by the following claims.

What is claimed is:

1. A gas burner system which is comprised of:
a mixing tube;
a gas orifice for introducing gas into said tube;
a head spaced away from said tube; and
a primary air flow control means located intermediate of said tube and said head such that said control means autoregulates an amount of primary air which can be entrained into said gas burner as a function of burner temperature by varying an effective cross-sectional area of a passage formed between said head and said control means such that a likelihood of lifting, flashback and elevated CO emissions is substantially reduced.

2. The gas burner system according to claim 1, wherein said primary air flow control means is further comprised of a thermoplastic, bimetallic material.

3. The gas burner system according to claim 1, wherein said primary air flow control means is further comprised of a tubular extension.

4. The gas burner system according to claim 2, wherein said primary air flow control means is further comprised of a tubular extension.

5. The gas burner system according to claim 3, wherein said extension is further comprised of:
longitudinally extending fingers defining slits therebetween.

6. The gas burner system according to claim 4, wherein said fingers substantially bend as said control means heats up such that said amount of primary air entrained into said burner is substantially increased.

7. The gas burner system according to claim 1, wherein said primary air flow control means is further comprised of a substantially smooth, rectangular diaphragm.

8. The gas burner system according to claim 2, wherein said primary air flow control means is further comprised of a substantially smooth, rectangular diaphragm.

9. The gas burner system according to claim 6, wherein said control means heats up such that said amount of primary air entrained into said burner is substantially increased.

10. A gas burner system which is comprised of:
a mixing tube;
a gas orifice for introducing gas into said tube;
a head spaced away from said tube; and
a primary air flow control means located intermediate of said tube and said head such that said control means autoregulates an amount of primary air which can be entrained into said gas burner such that a likelihood of lifting, flashback and elevated CO emissions is substantially reduced wherein said primary air flow control means is further comprised of a thermostatic, bimetallic material formed into a tubular extension such that said extension is comprised of longitudinally extending fingers defining slits there between with said fingers substantially bending as said control means heats up wherein a passage is formed between said head and said control means and an effective cross-sectional area of said passage is varied such that said amount of primary air entrained into said burner is substantially increased.

11. In an atmospheric gas burner of the type comprising a mixing tube and a burner head, which cooperatively form an air/gas injection passageway in which gas from an orifice mixes with entrained primary air enroute from the orifice to burner ports formed in the burner head, the improvement wherein the burner further comprises a means for autoregulating the amount of primary air entrained into the burner as a function of burner temperature such that the likelihood of lifting is substantially reduced, said autoregulating means further comprising a thermostatic bimetallic member disposed in the primary air injection passageway operative to vary the effective cross-sectional area of said passageway proximate said member as a function of the burner temperature to provide the desired autoregulation.

12. The improvement of claim 11 wherein said member comprises a tubular extension of the mixing tube, said extension being slitted to form therein longitudinally extending fingers, the free ends of said fingers being spaced from the burner head to define an annular gap therebetween, said gap comprising a portion of said passageway, said fingers being operative to flex outwardly to vary the effective cross-sectional area of said gas as a function of burner temperature.

13. The improvement of claim 11 wherein said member comprises a diaphragm supported in the burner head disposed substantially transverse to and spaced from the open end of the mixing tube and defining a gas therebetween, said gap comprising a portion of the air injection passageway, said diaphragm flexing as a function of burner temperature thereby varying the effective cross-sectional area of said gap.

* * * * *